US005333604A

United States Patent [19]

Green et al.

[11] Patent Number: 5,333,604

[45] Date of Patent: Aug. 2, 1994

[54] PATELLA EXERCISING APPARATUS

[75] Inventors: Robert S. Green; Louise M. Focht, both of San Diego, Calif.

[73] Assignee: Sutter Corporation, San Diego, Calif.

[21] Appl. No.: 945,535

[22] Filed: Sep. 16, 1992

[51] Int. Cl.[5] ..... A61H 1/02

[52] U.S. Cl. ..... 601/33; 601/34

[58] Field of Search ..... 128/25 R, 25 C, 782, 128/25 B; 606/241, 242; 602/16; 482/51

[56] References Cited

U.S. PATENT DOCUMENTS

| | | | |
|---|---|---|---|
| 2,696,206 | 12/1954 | Bierman | 128/25 |
| 3,661,149 | 5/1972 | Ferries | 128/25 R |
| 4,323,060 | 4/1982 | Pecheux | 128/84 |
| 4,487,199 | 12/1984 | Saringer | 128/25 |
| 4,492,222 | 1/1985 | Hajianpour | 128/25 |
| 4,501,266 | 2/1985 | McDaniel | 128/69 |
| 4,534,364 | 8/1985 | Lamoreux | 128/774 |
| 4,549,534 | 10/1985 | Zagorski et al. | 128/25 |
| 4,549,555 | 10/1985 | Fraser et al. | 128/782 |
| 4,558,692 | 12/1985 | Greiner | 128/25 |
| 4,566,440 | 1/1986 | Berner et al. | 128/25 |
| 4,583,554 | 4/1986 | Mittelman et al. | 128/774 |
| 4,583,555 | 4/1986 | Malcolm et al. | 128/782 |
| 4,621,620 | 11/1986 | Anderson | 128/25 |
| 4,649,934 | 3/1987 | Fraser et al. | 128/782 |
| 4,665,899 | 5/1987 | Farris et al. | 128/25 |
| 4,732,143 | 3/1988 | Kausek et al. | 602/16 |
| 4,776,587 | 10/1988 | Carlson et al. | 272/129 |
| 4,804,000 | 2/1989 | Lamb et al. | 128/774 |
| 4,834,057 | 5/1989 | McLeod, Jr. | 128/782 |
| 4,969,471 | 11/1990 | Daniel et al. | 128/774 |
| 4,974,830 | 12/1990 | Genovese et al. | 272/25 |
| 5,020,790 | 6/1991 | Beard et al. | 482/51 |
| 5,076,576 | 12/1991 | Johnston | 482/126 |
| 5,116,296 | 5/1992 | Watkins et al. | 482/91 |
| 5,156,163 | 10/1992 | Watkins et al. | 128/782 |

*Primary Examiner*—Richard J. Apley
*Assistant Examiner*—Jeanne M. Mollo
*Attorney, Agent, or Firm*—Nydegger & Associates

[57] ABSTRACT

A patella exercise device for continuously exercising the patella during continuous passive movement of the knee includes a patella contact pad mounted to a (CPM) device for contacting the patella while the knee is moved in flexion and extension by the (CPM) device. The patella contact pad is adapted to contact and push the patella from a neutral anatomical position during operation of the (CPM) device. Depending on the positioning of the patella contact pad with respect to the patella, the patella is either pushed superiorly or inferiorly during flexion and extension of the knee. The patella is then compressed and tightened during the opposite movement. The patella contact pad may be driven by a spring like cam member to exert a predetermined force against the patella. The patella exercise device is useful for therapy of a knee following injury or surgery and helps prevent patella baja.

20 Claims, 4 Drawing Sheets

PATELLA EXERCISING APPARATUS

TECHNICAL FIELD

This invention relates to medical devices and more particularly to a device for exercising and mobilizing the patella for therapy and rehabilitation of the knee.

BACKGROUND OF THE INVENTION

The knee joint provides articulation between the upper leg bone (the femur) and the lower leg bone (the tibia). The knee joint includes both internal and external components. The internal components include the cruciate ligaments and the articular cartilages. The external components include the capsule and collateral ligaments. The knee cap, or patella, rests generally on the femur and is enclosed by the patellar tendon. The patella serves as a bearing for force applied by the quadriceps muscles of the leg against the distal end of the femur. The patellofemoral joint allows the patella to slide on the curved lower end of the femur during flexion and extension of the leg.

A large number of knee injuries involve the anterior cruciate ligament (ACL). Rehabilitation of an (ACL) injury, as well as other injuries involving surgery of the knee, are aided by continuous passive motion (CPM) exercise devices. In general, such a continuous passive motion (CPM) exerciser is continuously driven and moves the knee joint in flexion and extension. This exercises the knee joint and promotes blood and synovium flow into the joint to help with the healing process.

It is also known that massage and movement of the patella apart from its anatomical movement with the knee joint will promote restoration of the patella function following a knee injury or surgery. Such a separate movement or mobilization of the patella may increase the flow of synovium into the patellofemoral joint, and augment the healing process. In particular, movement of the patella will help prevent a medical condition known as "patella baja". This condition may occur following a knee injury and is caused by immobilization or adhesion of the patella within the patellofemoral joint. Because of this condition, as the structure of the knee heals the patella may relocate in misalignment with respect to its natural anatomical position.

As an example, a prior art therapy device for mobilizing the patella includes a suction pad that is shaped to contact and apply a gentle suction to the patella. The suction pad can be manipulated by a therapist to move the patella around while the leg is held stationary. This movement not only moves the patella on the femur but also decompresses the patellofemoral joint and increases the flow of synovium to the knee.

In the past such exercise of the patella has been done manually apart from any continuous passive therapy of the knee joint such as occurs with a (CPM) device. This limits the repetitiveness and thus the effectiveness of this type of therapy. It would be advantageous to provide this type of patella mobilization in a continuous passive format similar to other types of (CPM) therapies. There is then, a need for a continuous passive motion (CPM) device that continuously exercises the patella apart from its natural movement with the knee joint.

Accordingly it is an object of the present invention to provide an apparatus for continuously exercising and mobilizing the patella that can be utilized as or in combination with a (CPM) exercise device for the knee. It is another object of the present invention to provide an apparatus for continuously exercising the patella that can be used to help prevent patella baja following a knee injury. It is yet another object of the invention to provide an apparatus for continuously exercising the patella that can decompress the patellofemoral joint and push the patella from its neutral anatomical position. It is a further object of the present invention to provide an apparatus for continuously exercising the patella that has a patella contacting member which can be moved away from the knee by the patient as a safety mechanism. Finally it is an object of the present invention to provide a CPM exercise device for continuously exercising the patella that is relatively inexpensive to manufacture and easy to use.

SUMMARY OF THE INVENTION

In accordance with the invention an apparatus for continuously exercising or mobilizing the patella for rehabilitation of the knee is provided. The patella exercising apparatus includes a patella contact pad mounted to a continuous passive motion (CPM) exercise device. The patella contact pad is adapted to contact and move the patella from its neutral anatomical position while the knee joint is moved by the (CPM) exercise device in flexion and extension. In an illustrative embodiment, during movement of the knee joint in flexion and extension by the (CPM) exercise device, the contact pad contacts the patella between about 30 degrees flexion and full extension to push the patella from a neutral anatomic position. The patella is then compressed and pulled back to a neutral position by the anatomy of the knee joint during movement of the knee joint between about 30 degrees flexion and full flexion.

The patella exercising apparatus includes the contact pad for contacting the patella and a support bracket for the contact pad which attaches to the (CPM) device. The support bracket is pivotally and drivably attached to the (CPM) device, driven by a cam and follower mechanism. The cam and follower mechanism is configured to drive the contact pad to exert a predetermined amount of force on the patella. In addition, the patella contact member is hingedly mounted to the support bracket and can be manually disengaged from the patella by the patient or therapist as a safety mechanism.

The novel features of this invention, as well as the invention itself, both as to its structure and its operation will best be understood from the accompanying drawings, taken in conjunction with the accompanying description in which similar reference characters refer to similar parts and in which:

DESCRIPTION OF PREFERRED EMBODIMENTS

Figure 1:
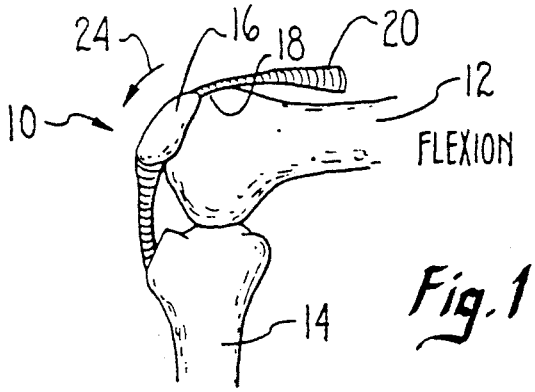
Fig. 1 (PRIOR ART)
FIG. 1 is a schematic side elevation view of a knee joint showing the knee in flexion.
Figure 2:
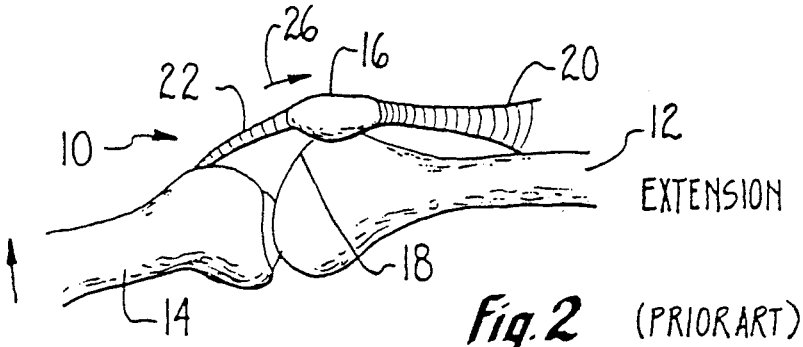
Fig. 2 (PRIOR ART)
FIG. 2 is a schematic side elevation view of a knee joint showing the knee in extension.

With reference to FIGS. 1 and 2 a knee joint 10 is shown in positions of full flexion (FIG. 1) and full extension (FIG. 2). The knee joint 10 provides articulation between the femur 12, (upper leg bone), and the tibia 14 (lower leg bone). The patella 16 slides on the curved lower end 18 of the femur 12 within the patellar femoral joint. The patella 16 serves as a bearing for force applied by the quadriceps muscles 20 of the leg to the femur 12 and to the tibia 14. The quadriceps muscles 20 come together and attach to the patella 16. The patella 16 in turn attaches to the patellar tendon 22 which attaches to the tibia 14.

As shown in FIG. 1, during flexion of the knee 10, the patella 16 slides on the curved lower end 18 of the femur 12 as indicated by arrow 24 in a generally inferior direction. This movement also tends to tighten the knee joint and compresses the patella 16 against the femur 12. As shown in FIG. 2, during extension of the knee, the patella 16 slides on the curved lower end 18 of the femur 12 as indicated by arrow 26 in a generally superior direction.

The patella exercise apparatus of the invention, simply stated, modifies this natural anatomical movement of the patella 16, by contacting and shifting the normal course of movement of the patella 16 during a continuous passive exercise. The patella 16 is thus moved separately during continuous passive movement of the knee 10 in flexion and extension. The patella exercise apparatus 30 may be operated to shift the patella either superiorly or inferiorly.

As an example, a patella contact pad 32 of the patella exercise apparatus 30 may contact a distal end of the patella 16 such that at full extension of the knee 10 the patella is shifted superiorly from its neutral position shown in FIG. 2. As the knee 10 is then flexed, the natural anatomical movement of the knee 10, as illustrated in FIG. 1, will compress and pull the patella 16 back to a neutral position. Such a superior movement of the patella will help to prevent the occurrence of patella baja. Alternately, a patella contact pad 32 may contact a proximal end of the patella 16 such that at full extension the patella 16 is shifted inferiorly from its neutral position. The patella contact pad 32 may also be situated to move the patella medially and laterally during continuous passive movement of the knee.

Figure 3:
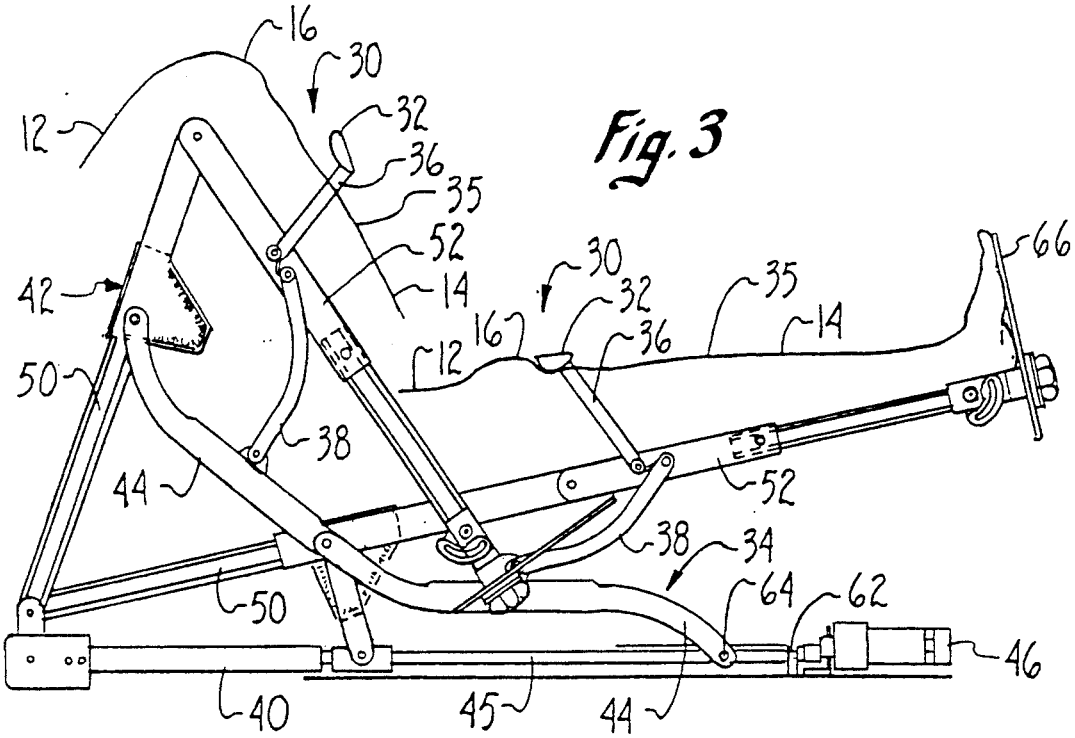
FIG. 3 is a side elevation view of a CPM device for the knee having a patella exercise device constructed in accordance with the invention shown in use for continuously exercising a patient's knee.

An illustrative embodiment of the patella exercise apparatus of the invention is shown in FIG. 3 and is generally designated as 30. The patella exercise apparatus 30 is illustrated in connection with a continuous passive motion (CPM) exercise device generally designated as 34. In general the (CPM) exercise device 34 is adapted to move the knee joint 10 of a patient in extension and flexion substantially as shown by the two positions of the leg 35 in FIG. 3. The generally V-shaped position of the leg 35 and (CPM) exercise device 34 shown in FIG. 3 corresponds to full flexion of the knee 10. The generally straight position of the leg 35 and (CPM) exercise device 34 shown in FIG. 3 corresponds to full extension of the knee 10. Although the (CPM) exercise device 34 is initially discussed herein in terms of only one side of the structure, it is to be understood that the (CPM) exercise device 34 preferably includes parallel articulatable four-bar structures which operate in concert with each other.

The patella exercise apparatus 30 of the invention, is driven by the motion of the (CPM) device 34. The patella exercise apparatus 30 includes the contact pad 32 for contacting and moving the patient's patella 16 and a support bracket 36 attached to the contact pad 32 for supporting the patella contact pad 32 above and in contact with the patella 16. The support bracket 36 is driven by the cross link member 38 of the (CPM) exercise device 34. As will be more fully explained, the cross link member 38 is adapted for a continuous reciprocating arc range of motion by a drive member 44 of the (CPM) exercise device 34.

The patella contact pad 32 is shaped to make contact with the patella 16. As such the patella contact pad 32 may be formed with a generally convex surface for contacting the patella 16. Other shapes, however, for the patella contact pad 32 may also be utilized. In addition, the patella contact pad 32 may be shaped such that the patella 16 of the patient is contacted but an incision on the patient's knee (not shown) 10 such as would occur after knee surgery may or may not be contacted during operation of the patella exercising apparatus 30. The patella contact pad 32 may be situated to contact either the distal or proximal end of the patella 16. The patella contact pad 32 may be formed of a relatively soft compressible material such as an elastomeric foam or a harder material such as molded plastic.

In an illustrative embodiment, the (CPM) exercise device 34 includes a base 40 on which is mounted a limb support member generally designated as 42. The limb support member 42 is an articulatable structure adapted to support the patients leg 35 for continuous passive motion in flexion and extension. A drive linkage 44 of the (CPM) exercise device 34 is slidably mounted on a slide member 45 using a slide connection 64. A reversible drive motor 46 is used to move the drive linkage 44 in a reciprocating motion on the slide member 45. The drive motor 46 is drivably coupled to the drive linkage 44 using a rotatable drive screw 62. The drive screw 62 is journaled for rotation about its longitudinal axis. A drive nut (not shown) is threadably coupled to the drive screw 62 for linear motion along the drive screw 62 as it is rotated. This linear motion is transmitted to the drive linkage 44 using a connecting member (not shown). The linear motion of the drive linkage 44 in turn is transmitted to a femoral support member 50. Similarly, motion of the drive linkage 44 is transmitted through a cross link member 38 to a tibial support member 52. Because of the construction and pivoting of the drive linkage 44, and cross link member 38, a patient's leg 35 can be moved in extension and flexion. Moreover, the range of motion of extension and flexion of the leg can be adjusted utilizing suitable adjustment and control means. A foot support 66 supports the patients foot during this continuous passive motion. Suitable attaching means such as straps or hinged plates (not shown) may be utilized to removably attached the patients leg to the limb support member 42 and foot support 66.

Figure 4:
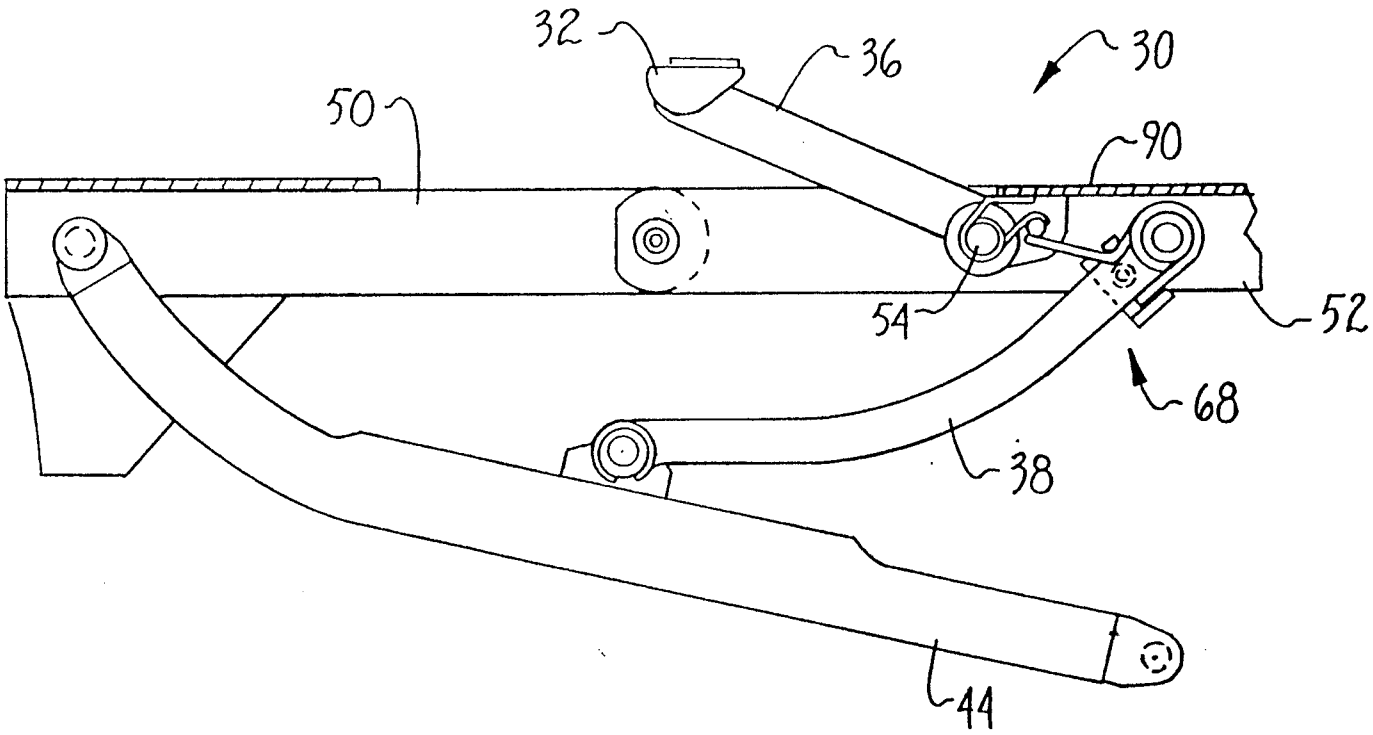
FIG. 4 is a schematic side elevation view of the patella exercise device of FIG. 3 shown at a full extension of the knee.
Figures 5, 6:
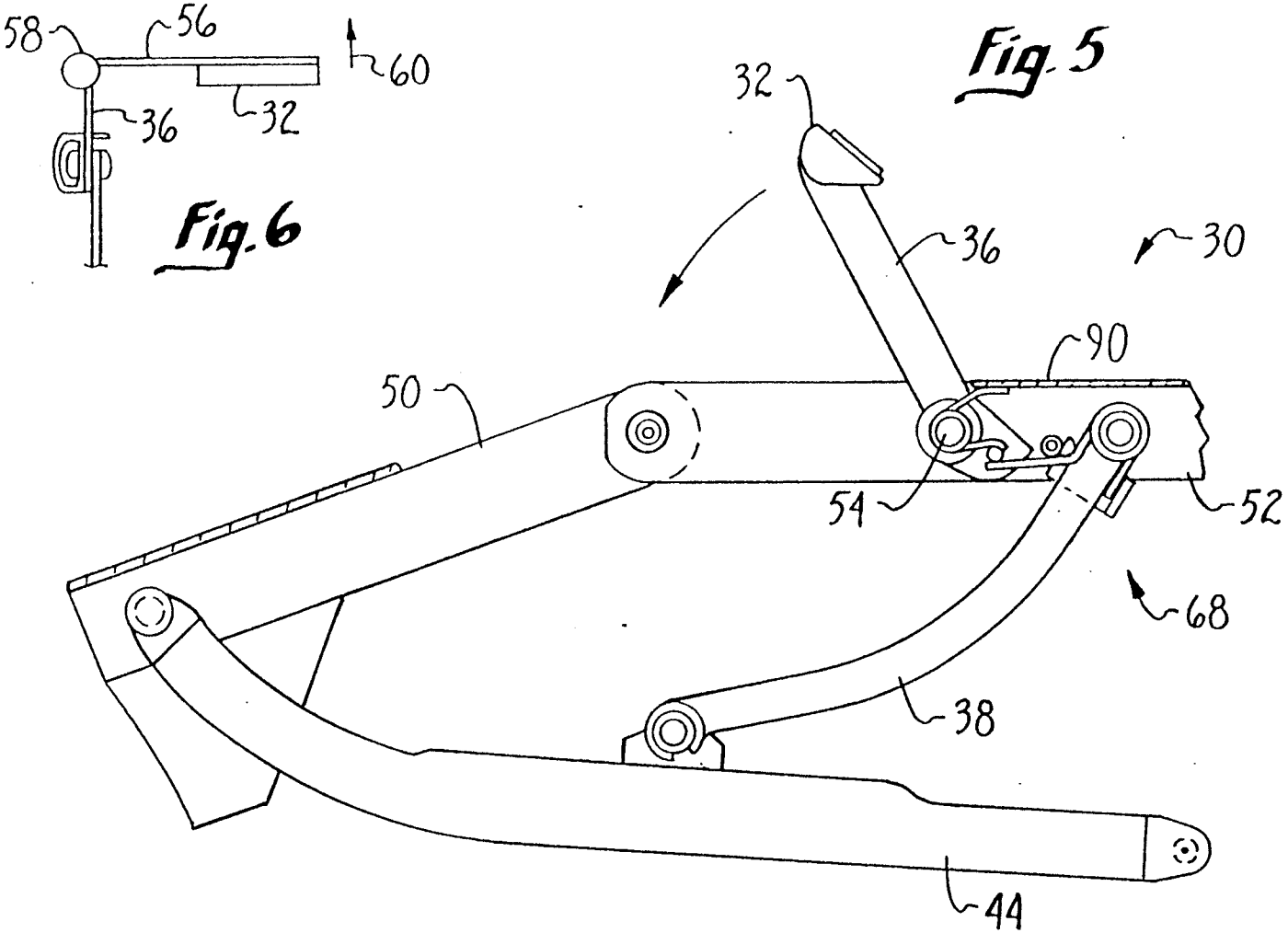
FIG. 5 is a schematic side elevation view of the patella exercise device of FIG. 3 shown at about thirty degrees flexion of the knee.
FIG. 6 is a schematic side elevation view of FIG. 4.

Referring now to FIGS. 4, 5, and 6 the patella exercise apparatus 30 is shown in more detail. The support bracket 36 for the patella exercise apparatus 30 is a cantilevered structure adapted to support the patella contact pad 32 generally above and in contact with the patella 16 during movement of the patient's leg by the (CPM) exercise device 34. The support bracket 36 for the patella exercise device 30 is pivotally mounted to the tibial support member 52 of the CPM exercise device 34 using a pivot connection 54.

As shown in FIG. 6 the patella contact pad 32 is attached to a contact pad support member 56. The contact pad support member 56 is hingedly connected to the support bracket 36 using a hinge connection 58. The hinge connection 58 is constructed to support the contact pad 32 in a cantilevered position substantially as shown in FIG. 6. In addition the hinge connection 58 is constructed to allow the contact pad 32 to be moved or swung upward as indicated by arrow 60. With this arrangement the contact pad 32 can be placed in contact with the patella 16 or swung away and disengaged from the patella 16 as desired. This provides a safety mechanism which allows the patient or therapist to move or position the patella contact pad 32 away from the patient's patella to render the patella exercise apparatus 30 as inoperative.

The support bracket 36 is driven by a cam and follower drive arrangement that is generally designated as 68 in FIGS. 4 and 5. This cam and follower drive arrangement 68 is shown in more detail in FIG. 7 and will be more particularly hereinafter described. The cam and follower drive arrangement 68 is configured to exert a controlled force on the support bracket 36 such that the patella contact pad 32 contacts the patella 16 with a predetermined force.

Figure 7:
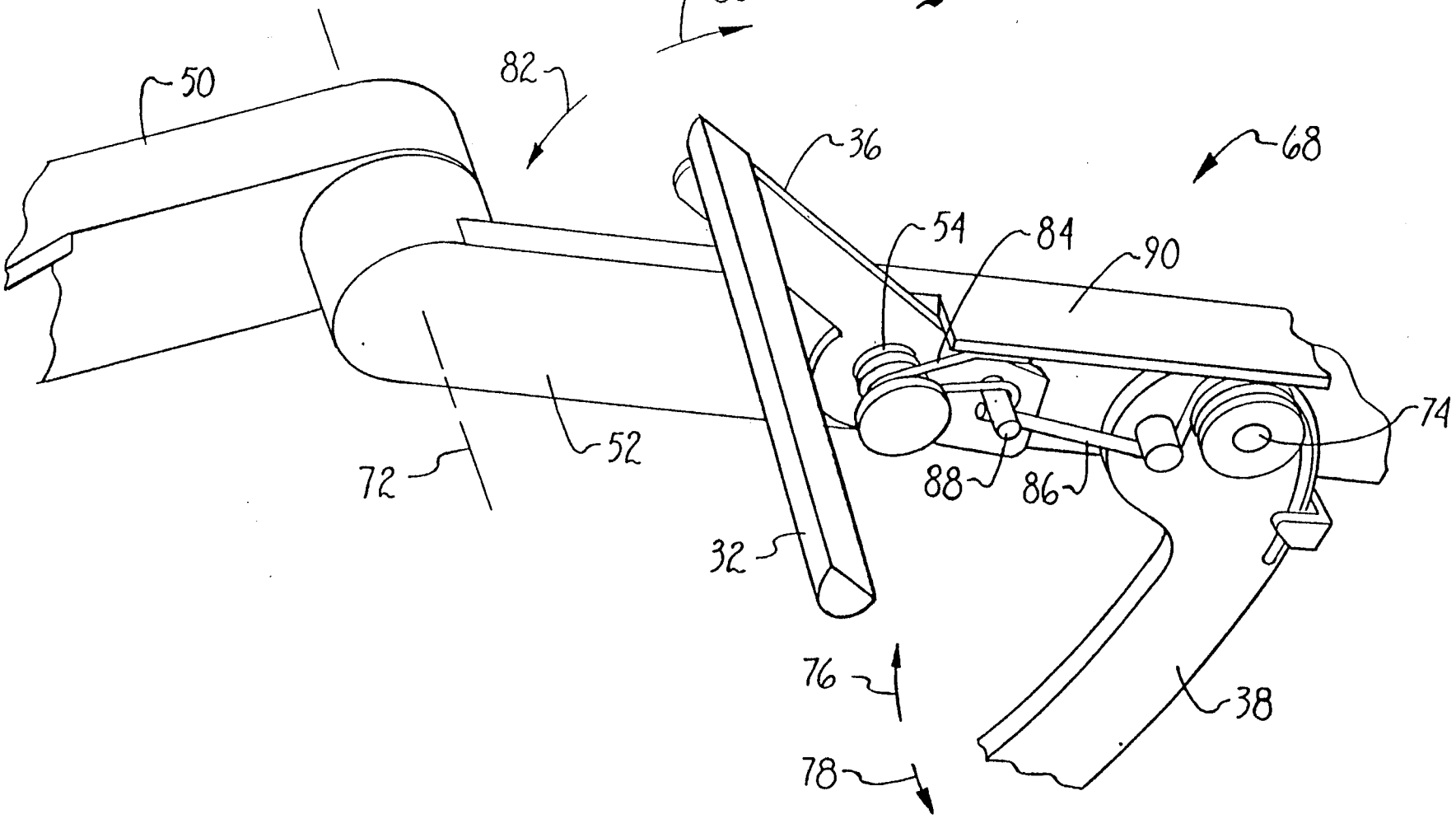
FIG. 7 is a perspective view of a cam and follower drive arrangement for a patella exercise apparatus constructed in accordance with the invention.

Referring now to FIG. 7 the cam and follower drive arrangement 68 for the patella exercise apparatus 30 is shown. The tibial support member 52 of the CPM exercise device 34 is pivotally attached to the femoral support member 50 along a pivotal axis 72 that corresponds to a lateral pivotal axis of the knee joint 10 of the patient. The cross link member 38 of the CPM exercise device 34 is pivotally attached at pivot connection 74 to the tibial support member 52. An arc range of motion of the cross link member 38 is indicated by arrow 76 which corresponds to a rising direction of motion and by arrow 78 which corresponds to a falling direction of motion.

The support bracket 36 is pivotally attached to the tibial support member 52 along the pivot connection 54. An arc range of motion of the support bracket 36 is indicated by arrow 80 which corresponds to a rising direction of motion and by arrow 82 which corresponds to a falling direction of motion. A torsion spring member 84 is connected to the pivot connection 54 for the support member 52. The torsion spring member 84 exerts a predetermined torsional force and functions as a return spring for the support bracket 36. The torsion spring member 84 is connected to a follower pin 88 at one end and bears against a flange 90 that extends from the tibial support member 52 at the opposite end.

An actuation spring 86 is attached to the cross link member 38 for movement with the cross link member 38. The actuation spring 86 functions as a cam member for moving the support bracket 36 to drive the patella contact member 32. The actuation spring 86 cooperates with the follower pin 88 attached to the support bracket 36. A rising movement of the cross link member 38 such as would occur as the patients leg is moved in extension causes the actuation spring 86 to bear against the follower pin 88 and move the support arm 36 for the patella contact pad 32 in a falling direction as indicated by arrow 82. This motion pushes the patella contact pad 32 towards the patient's patella 16. The dimensioning and positioning of the cooperating members is such that the patella contact pad 32 is pushed into engagement with the patella 16 from about 30 degrees of flexion to full extension of the leg. In addition the force exerted by the contact pad 32 on the patella 16 is preferably in the range of from two to six pounds. Since the actuation spring 86 is flexible the flexibility of the spring 86 will act as a safety mechanism to prevent the transmission of excessive or harmful forces to the patient and machinery.

On the other hand, movement of the cross link member 38 in a falling direction, as indicated by arrow 78, moves the actuation spring 86 away from the follower pin 88 and allows the torsion spring 84 to move the support bracket 36 in a rising direction as indicated by arrow 80. During this movement which corresponds to flexion of the knee the patella contact pad 32 is moved away from contact with the patella 16.

The patella contact pad 32 is thus adapted to contact the patient's patella 16, with a predetermined force and to move the patella 16 from a neutral position. As shown in FIG. 3, the patella contact pad 32 may be situated to contact a proximal portion of the patella 16 and exert a downward force on the patella 16 from about 30 degrees flexion through full extension. This moves the patella in an inferior direction from its neutral anatomical position. (If a distal portion of the patella 16 is contacted, by the contact pad 32 the patella 16 may be pushed from its neutral anatomical position in a superior direction.) During a return flexion movement of the knee 10, the patella contact pad 32 continues to exert pressure on the patella 16, from full extension to 30 degrees flexion while the flexion movement tightens the patella 16 and pulls the patella 16 back to an inferior position. No pressure is applied to the patella during flexion after about 30 degrees of flexion. Maximum displacement of the patella 16 thus occurs when the knee is fully extended.

During the (CPM) exercise of the knee 10, the patella 16 is continuously pushed from its natural path and the patellofemoral joint is alternately compressed and decompressed. This motion is similar to pushing against the edge of a wet watermelon seed with your finger. The watermelon seed can be compressed and laterally displaced at the same time. In a similar manner, the patella 16 is subjected to both a compressive force and a lateral displacement force by the patella contact pad 32. The driving force is supplied by the motion of the (CPM) exercise device 34 in moving the knee in flexion and extension. Extension of the knee 10 moves the patella 16 from a neutral position and decompresses the patellofemoral joint. Flexion tightens the patella 16 and compresses the patellofemoral joint. This motion is therapeutic to an injured knee and helps to prevent patella baja as previously explained.

The patella contact pad 32 may alternately be located to contact a distal end of the patella 16. With this arrangement the above described movement of the patella 16 is reversed. Flexion motion of the knee 10, by the (CPM) exercise device 34 decompresses and pushes the patella 16 in superior direction. Extension motion of the knee 10 by the (CPM) exercise device 34 compresses and tightens the patella 16 back to a neutral position.

Although it is preferable to operate the patella exercise apparatus 30 of the invention with a continuous motion exercise device, such as the (CPM) exercise device 34, it is apparent that the lower leg can be moved manually by a therapist, to replicate the same movement of the patella 16.

Thus the invention provides a simple yet unobvious device for continuously exercising and mobilizing the patella in conjunction with therapy for an injured knee and in avoiding patella baja during rehabilitation of a knee injury.

While the particular Patella Exercising Apparatus as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

We claim:

1. An apparatus for exercising a patella of a knee joint of a patient during exercise of the knee, comprising:

a continuous passive motion device for continuously moving the knee joint in flexion and extension; and patella contact means mountable on the continuous passive motion device for contacting the patella and displacing the patella from a neutral anatomical position when the knee of the patient is in a substantially extended position.

2. The apparatus as defined in claim 1 and wherein:

the patella contact means is oriented to contact the patella and push the patella superiorly during extension of the knee.

3. The apparatus as defined in claim 1 and wherein:

the patella contact means is oriented to contact the patella and push the patella inferiorly during extension of the knee.

4. The apparatus as defined in claim 1 and wherein:

the patella contact means comprises a contact pad shaped to displace the patella.

5. The apparatus as defined in claim 1 and wherein:

the patella contact means is oriented to contact the patella only between about 30 degrees flexion and full extension of the knee.

6. The apparatus as defined in claim 1 and wherein:

the means for continuously moving the knee joint is a continuous passive motion device for moving the knee joint in flexion and extension.

7. The apparatus as defined in claim 1 and wherein:

the patella contact means is resiliently mounted to exert a predetermined contact force on the patella.

8. The apparatus as defined in claim 1 and wherein:

the patella contact means is adapted to be removed from the patella by the patient while the means for moving the knee joint is still attached to the knee.

9. An apparatus for exercising a patella of a patient's knee comprising:

a continuous passive motion device for moving the patient's knee in extension and flexion;

a patella contact support bracket drivably mounted to the continuous passive motion device for displacing the patella from a neutral anatomical position during movement of the knee by the continuous passive motion device; and a contact pad mountable on the support bracket for contacting the patella.

10. The apparatus as defined in claim 9 and wherein:

the patella contact pad is located to contact the patella and push the patella superiorly during extension of the knee.

11. The apparatus as claimed in claim 9 and wherein:

the patella contact pad contacts the patella between about 30 degrees of flexion and full extension of the knee.

12. The apparatus as claimed in claim 9 and wherein;

the contact pad is biased against the patella with a predetermined force.

13. The apparatus as defined in claim 9 and wherein:

the contact pad is hingedly mounted so as to be moved out of contact with the patella by the patient.

14. The apparatus as defined in claim 9 and wherein:

the patella contact support bracket is pivotably mounted to the continuous passive motion device such that pivoting of the support bracket is caused by a cam follower on the support bracket being moved by a cam member on the passive motion device.

15. A patella exercising device useful for continuously moving and decompressing a patella of a knee joint of a patient and for preventing patella baja, comprising:

a continuous passive motion device for continuously moving the patient's knee joint in flexion and extension;

a patella contact pad mounted to a support bracket pivotally attached to the continuous passive motion device for contacting the patella during flexion and extension of the knee and for shifting the patella from a neutral anatomical position so that the patella may be pushed and decompressed by the patella contact pad during flexion and extension of the knee by the continuous passive motion device;

a cam member drivably mounted to the continuous passive motion device for driving the patella contact pad; and a follower member connected to the support bracket for the patella contact member adapted to be contacted and driven by the cam member for moving the patella contact pad into and out of contact with the patella.

16. The patella exercising device as claimed in claim 15 and wherein:

the cam member is formed as a spring member adapted to push the patella contact pad against the patella with a predetermined force.

17. The patella exercising device as claimed in claim 15 and wherein:

the patella contact pad is hingedly attached to the support bracket and can be swung out of engagement with the patella.

18. The patella exercising device as claimed in claim 15 and wherein:

the patella contact pad is adapted to contact the patella between about 30 degrees of flexion and full extension of the knee.

19. The patella exercising device as claimed in claim 15 and wherein:

the patella contact pad is moved out of engagement with the patella by a torsion spring.

20. The patella exercising device as claimed in claim 15 and wherein:

the patella contact pad has a generally convex outer peripheral shape.

* * * * *